US006000572A

United States Patent [19]

Kako et al.

[11] Patent Number: 6,000,572

[45] Date of Patent: Dec. 14, 1999

[54] CONSOLE BOX

[75] Inventors: Junichiro Kako, Aichi-ken; Shigeru Yabuya, Inuyama; Minoru Shibata, Inazawa; Masahiro Ono, Okazaki, all of Japan

[73] Assignee: Toyoda Gosei Co., Ltd., Aichi-ken, Japan

[21] Appl. No.: 08/758,569

[22] Filed: Dec. 3, 1996

[30] Foreign Application Priority Data

Dec. 4, 1995 [JP] Japan ..... 7-315382

[51] Int. Cl.[6] ..... B65D 85/00

[52] U.S. Cl. ..... 220/522

[58] Field of Search ..... 220/521, 522

[56] References Cited

U.S. PATENT DOCUMENTS

| | | | |
|---|---|---|---|
| 2,672,232 | 3/1954 | Kessell, Jr. | 220/521 X |
| 2,673,783 | 3/1954 | Rahm et al. | 220/522 X |
| 3,578,153 | 5/1971 | Olson | 220/522 X |
| 4,984,687 | 1/1991 | Hanna et al. | 220/522 X |

FOREIGN PATENT DOCUMENTS

| | | |
|---|---|---|
| 58-44237 | 9/1956 | Japan . |
| 58-46643 | 9/1956 | Japan . |
| 1-77541 | 5/1964 | Japan . |
| 58-113562 | 8/1983 | Japan . |
| 58-121733 | 8/1983 | Japan . |

*Primary Examiner*—Steven M. Pollard
*Attorney, Agent, or Firm*—Cushman Darby & Cushman, IP Group of Pillsbury Madison & Sutro LLP

[57] ABSTRACT

A console box for storing small articles includes a box body, an outer lid pivotally mounted for opening and closing the box body and an inner lid disposed between the box body and the outer lid. The box body has a first space for storing small articles. The outer lid pivots within a first angle with respect to the box body. The outer lid is box-shaped and has a second space inside. The inner lid has a third space for storing other small articles. The inner lid is located in the second space of the outer lid when the outer lid is closed. The inner lid pivots in accordance with the movement of the outer lid to a second angle that is smaller than the first angle with respect to the box body. The box body according to the present invention may have a stopper for limiting a maximum opening angle of the outer lid.

19 Claims, 7 Drawing Sheets

CONSOLE BOX

BACKGROUND OF THE INVENTION

1. Field of the Invention

The present invention relates to a console box provided inside a vehicle's compartment.

2. Description of the Related Art

A console box is placed between the driver's seat and the passenger's seat in a vehicle. The console box typically includes a rectangular parallelepiped box body and a lid that is hinged to the box at an end (for example, at the rear end). The interior of the box body is used for storing small articles. The lid includes a plate and four side walls surrounding the plate, which define an open storage space. The rotation of the lid with respect to the box body around the hinge opens and closes the box body.

There is a demand for an effective usage of the space defined by the lid of a console box. Japanese Unexamined Utility Model Publication No. 58-113562 discloses such a usage of the space inside the lid. As shown in FIG. 8, a console box 100 according to the above publication includes a box body 101, an outer lid 102 that has a U-shaped cross section and an inner lid 103. The inner lid 103 is placed between the box body 101 and the outer lid 102. The inner lid 103 divides the space defined by the box body 101 and the outer lid 102. This allows the space on top of the inner lid 103 to be used for storing small articles in addition to the space in the box body 101.

The above console box 100 is opened by two different actions. The first action, opening the outer lid 102 together with the inner lid 103, opens the box body 101 and permits small articles to be placed inside. A second action is to open only the outer lid 102. This permits the space defined by the outer lid 102 and the inner lid 103 to be used for storing small articles. These two different actions require two different opening operations and switching between the two actions is complicated. This has created a need for a console box that uses the interior of the outer lid 102 and is simply operated.

SUMMARY OF THE INVENTION

Accordingly, it is an objective of the present invention to provide a console box having an outer lid and an inner lid, which box utilizes its entire inner space including the space inside the outer lid, and which has improved operability in the opening and closing of the inner and outer lids.

To achieve the foregoing and other objectives and in accordance with the purpose of the present invention, a console box for storing small articles includes a box body, an outer lid pivotally mounted for opening and closing of the box body and an inner lid disposed between the box body and the outer lid. The box body has a first space for storing small articles. The outer lid pivots within a first angle with respect to the box body. The outer lid is box-shaped and has a second space inside. The inner lid has a third space for storing other small articles. The inner lid is located in the second space of the outer lid when the outer lid is closed. The inner lid pivots in accordance with the movement of the outer lid to a second angle that is smaller than the first angle with respect to the box body. The box body according to the present invention may have a stopper for limiting a maximum opening angle of the outer lid. The console box according to the present invention may further have a check arm for connecting the outer lid with the inner lid. The check arm according to the present invention may have a first and a second end. The first end may be connected to both the outer and inner lid, and a second end may have a portion engageable with the stopper. In the console box according to the present invention, the inner lid may be fixed to the check arm. In this case an angle formed by the inner lid and the check arm is smaller than an angle formed by the outer lid and the check arm when the second end is engaged with the stopper.

Other aspects and advantages of the invention will become apparent from the following description, taken in conjunction with the accompanying drawings, illustrating by way of example the principal features of the invention.

BRIEF DESCRIPTION OF THE DRAWINGS

FIG. 6A is a side view illustrating the assemblage of an inner lid and a check arm in a console box.

FIG. 6B is a cross-sectional view illustrating the assemblage of an inner lid, a check arm and an outer lid.

FIG. 7 is a side view illustrating a movement of an inner lid of a console box.

DETAILED DESCRIPTION OF THE PREFERRED EMBODIMENTS

A console box according to a first embodiment of the present invention will be described with reference to FIGS. 1 to 5.

Figure 4:
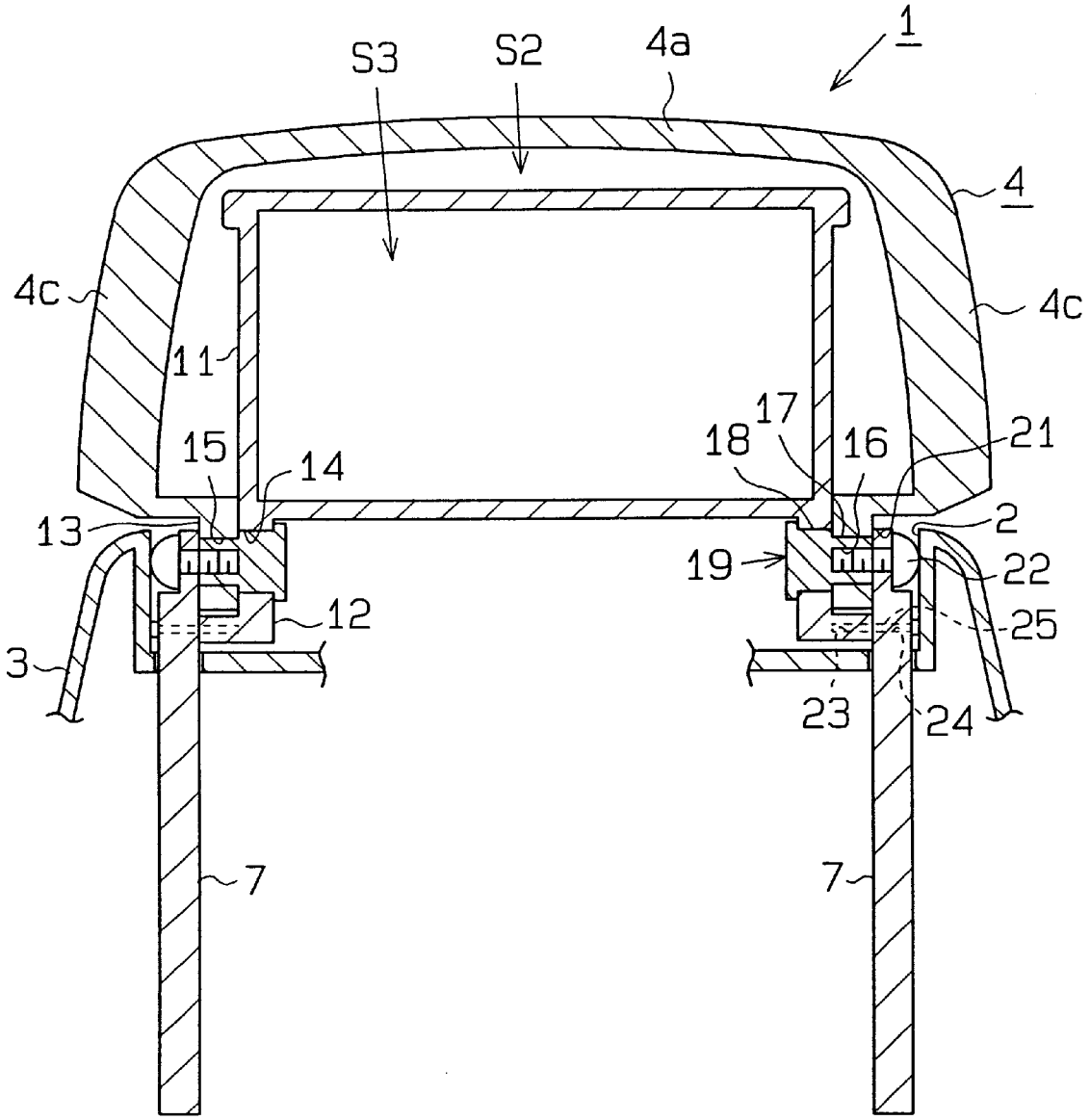
FIG. 4 is a cross-sectional view illustrating the relative positions of an inner lid, an outer lid, and check arm.
Figure 5:
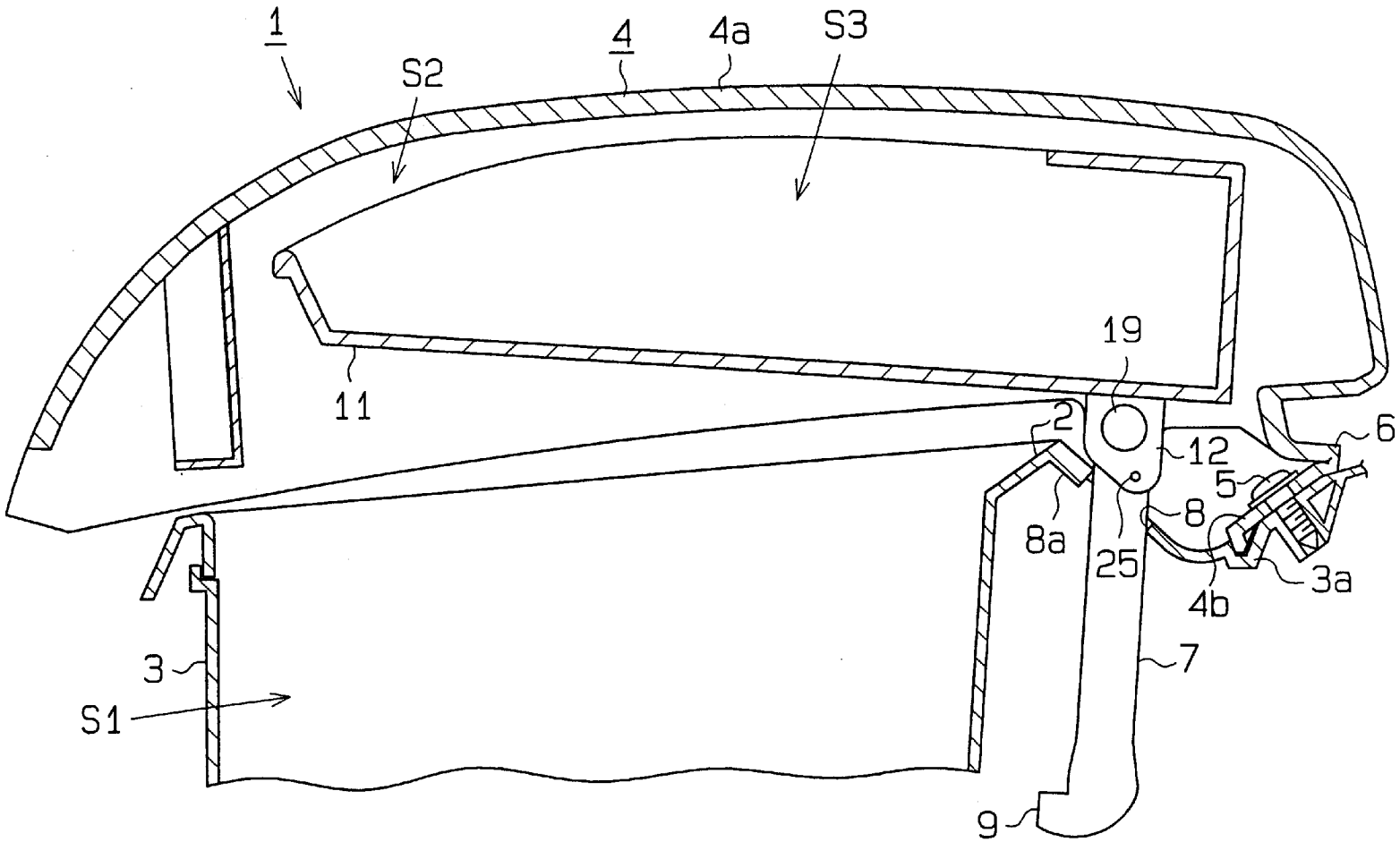
FIG. 5 is a cross-sectional view illustrating a console box with both the outer lid and the inner lid closed.

As shown in FIGS. 4 and 5, the console box 1 includes a box body 3 having an opening 2 at its top, an outer lid 4 for opening and closing the opening 2 and an inner lid 11 provided between the box body 3 and the outer lid 4. In this specification, the right end of FIG. 5 is the rear end of the console box 1 and the left end is the front end of the console box 1.

The box body 3 is a rectangular parallelepiped and has a space S1 defined by its bottom and walls, in which small articles are stored. As shown in FIG. 5, the rear end of the box body 3 is elongated to form a coupler 3*a*. As shown in FIGS. 4 and 5, the outer lid 4 has a top 4*a* that curves outwardly from the front end to the rear end, side walls 4*c*, a hinge 6 and a tang 4*b* extending forward from the hinge 6. The top 4*a* and side walls 4*c* of the outer lid 4 define a space S2. The tang 4*b* of the outer lid 4 is secured to the coupler 3*a* of the box body 3 by a screw 5. The outer lid 4 rotates with respect to its tang 4*b*. The hinge 6 serves as the axis of the outer lid's rotation which permits the outer lid 4 to be opened and closed.

Figure 2:
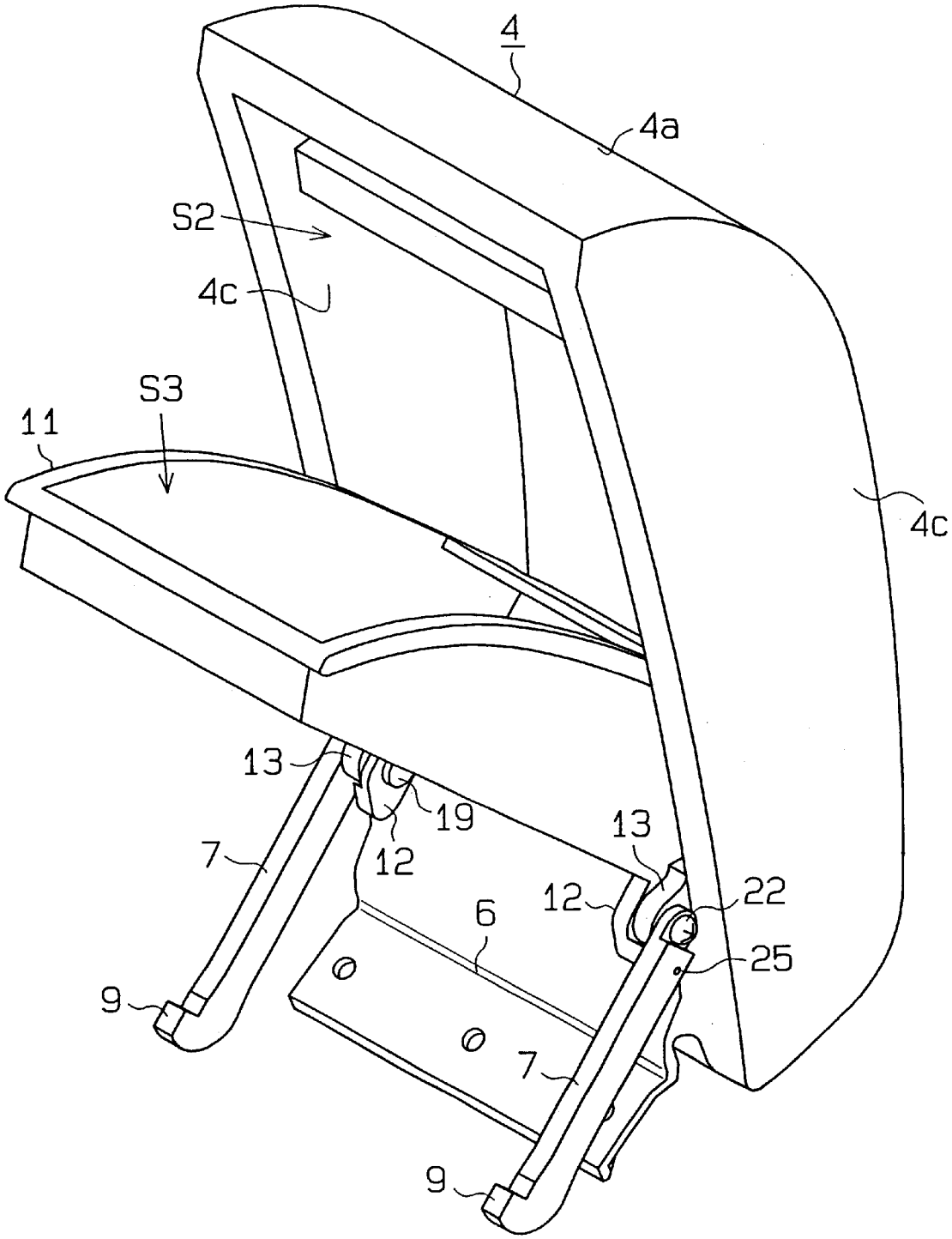
FIG. 2 is a perspective view illustrating a part of a console box in which an outer lid and an inner lid are opened.

As shown in FIGS. 2 and 4, the outer lid 4 has a pair of brackets 13 each of which is integrally formed with the side walls 4*c*. The brackets 13 are placed forward of the hinge 6 and are coupled to a pair of check arms 7. The check arms 7 rotate with respect to the outer lid 4. The assemblage of the console box 1 will be described in detail later.

As shown in FIG. 5, a pair of holes 8 are formed in the front portion of the coupler 3*a*. The holes 8 are slightly larger than the check arms 7, which are inserted in hole 8. A stopper 8*a* is formed in the vicinity of the front end of each hole 8. The stopper 8*a* engages with the check arm 7. Each check arm 7 has a protrusion 9 protruding forward from its second end. A clockwise rotation of the check arms 7 engages the protrusion 9 with the stopper 8*a*. The stopper 8*a* stops the rotation of the check arms 7 so that the arms 7 do not rotate beyond a predetermined degree. Accordingly, the engagement of the protrusion 9 with the stopper 8*a* defines the maximum opening angle of the outer lid 4. The inner lid 11 has a space S3 that opens at its top.

The characteristics of the first embodiment will now be described. As described above, the inner lid 11 is provided between the box body 3 and the outer lid 4. The inner lid 11 is accommodated in the space S2 in the outer lid 4. The first end of each check arm 7 is secured to the rear end of the inner lid 11. The inner lid 11 has integrally formed brackets 12 on both sides near its rear end. As shown in FIGS. 2 and 4, each bracket 12 is located inside and next to each bracket 13. The first end of the check arms 7 is placed outside and next to the brackets 13.

Figure 3:
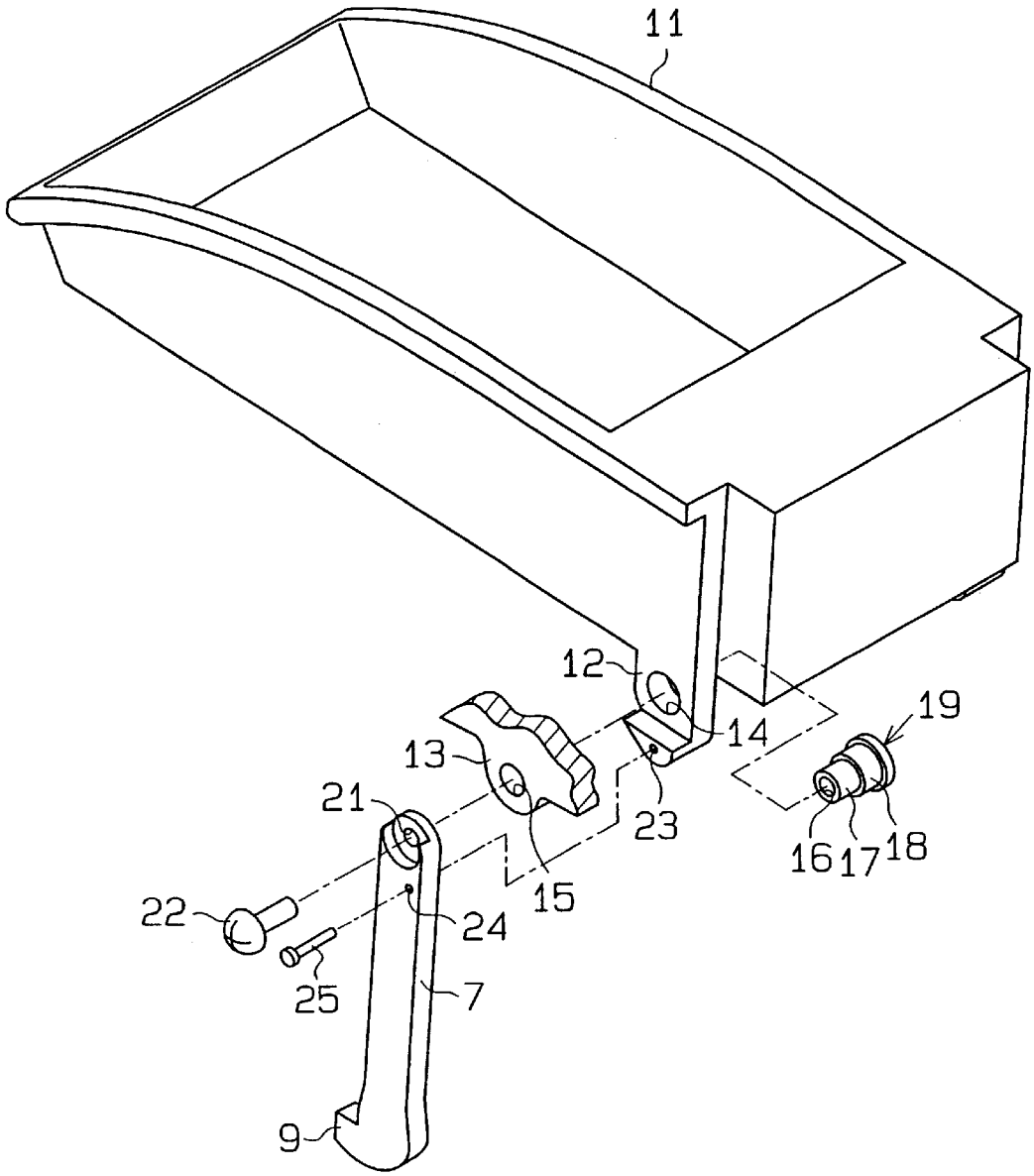
FIG. 3 is an exploded perspective view illustrating the assembly of an inner lid and a check arm of a console box.

As shown in FIG. 3, each bracket 12 of the inner lid 11 has a hole 14. Each bracket 13 of the outer lid 4 has a hole 15 the diameter of which is smaller than that of the holes 14. The bracket 12 and the outer lid 4 are arranged such that each hole 14 aligns with each hole 15. A collar 19 is fitted into each pair of holes 14 and holes 15. Each collar 19 has an internally threaded hole 16, a small diameter portion 17 and a large diameter portion 18. The small diameter portion 17 is fitted into the hole 15 of the outer lid's bracket 13 and the large diameter portion 18 is fitted into the hole 14 of the inner lid's bracket 12.

Each check arm 7 has a hole 21 in its first end. The check arm's hole 21 and the collar's internally threaded hole 16 are arranged to match each other. A screw 22 is inserted into each hole 21 and screwed into each threaded hole 16. The screw 22 and the collar 19 hold the brackets 12, 13 and the arm 7.

The check arms 7 contact the bottom part of the inner lid's bracket 12. The bracket 12 has pin holes 23 formed below the holes 14. The check arms 7 also have pin holes 24 formed below the hole 21. The pin holes 23 and 24 are aligned to match. A pin 25 is inserted through the holes 23 and 24 which fixes the check arms 7 with respect to the inner lid 11.

The above structure allows the inner lid 11 to rotate with respect to the outer lid 4 around the collar 19 while the pins 25 restrict the movement of the inner lid 11 with respect to the check arms 7. The outer lid 4 rotates with respect to the box body 3 around the hinge 6. The movement of the check arms 7 is interlocked with the movement of the outer lid 4. Specifically, the rotational motion of the outer lid 4 about the hinge 6 causes the check arms 7 to move vertically.

Figure 1:
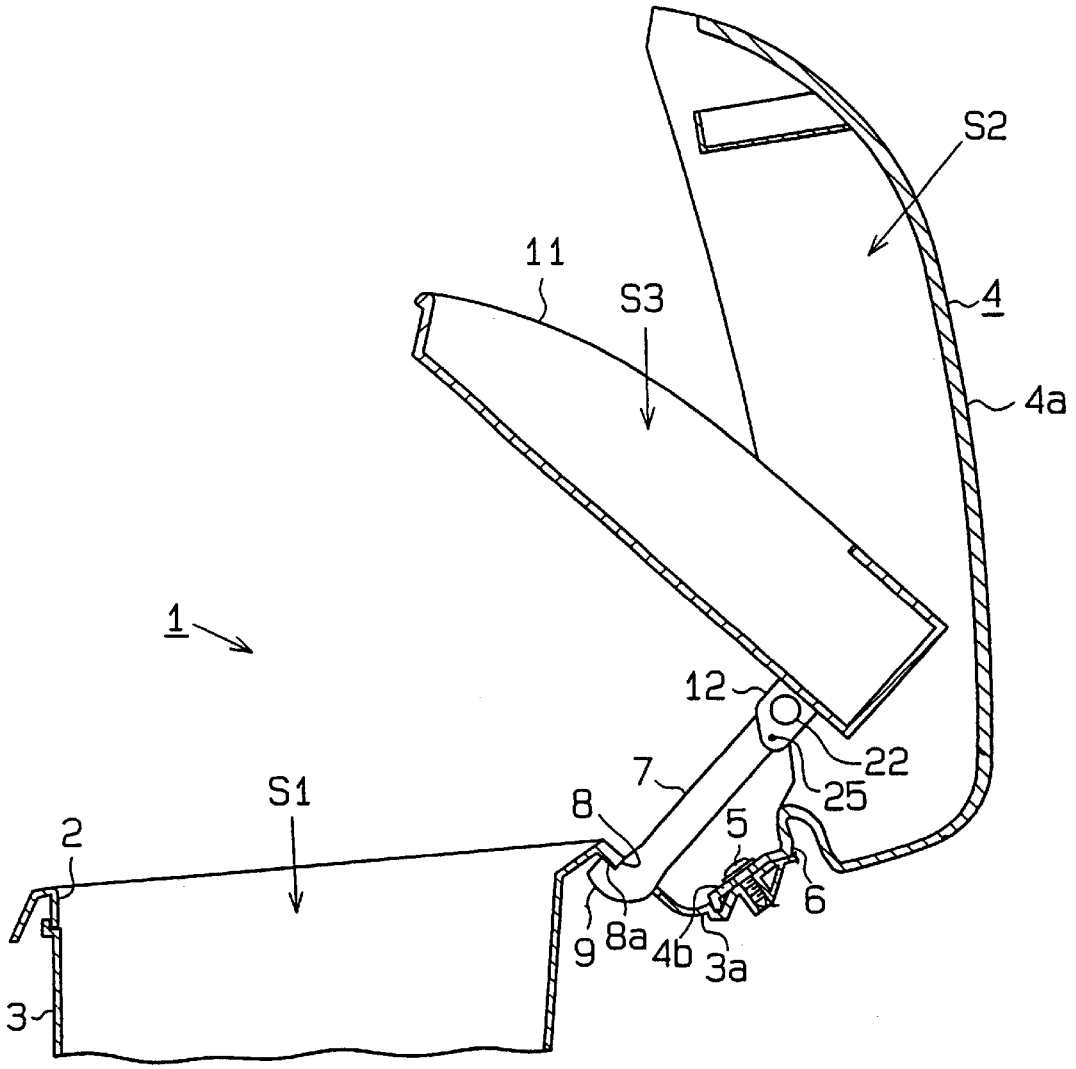
FIG. 1 is a cross-sectional view of a console box according to a first embodiment of the present invention.

The operation of the above console box 1 will now be explained. As shown in FIGS. 1 and 2, the outer lid 4 of the console box 1 is rotated in the clockwise direction to open the box body 3. This allows the space S1 inside the box body 3 to be utilized.

As described above, the movement of the check arms 7 is interlocked with the movement of the outer lid 4. Continually rotating the outer lid 4 engages the protrusions 9 of the check arms 7 with the stopper 8*a* of the box body 3. This stops the rotation of the outer lid 4.

The pins 25 restrict the rotation of the inner lid 11 with respect to the check arms 7. The opening motion of the outer lid 4 causes the check arms 7 to rotate with respect to the hinge 6. As shown in FIGS. 1 and 2, the movement of the inner lid 11 is interlocked with the movement of the check arms 7. The angle between the inner lid 11 and the check arms 7 is substantially ninety degrees. The inner lid 11 rotates within a range that is smaller than the rotation range of the outer lid 4. Accordingly, when the inner lid 11 is at the most opened position, the inner lid 11 is not covered with the outer lid 4.

As described above, operating only the outer lid 4 allows the space S3 in the inner lid 11 to be utilized. This means that the inner space S2 of the outer lid 4 is effectively utilized. In addition, in this embodiment, the opening and closing of the inner lid 11 is interlocked with the opening and closing of the outer lid 4. This simplifies the operation of the console box 1.

In the above embodiment, the inner lid 11 and the check arms 7 are separately formed and the collars 19 and the pins 25 fix the check arms 7 with respect to the inner lid 11. However, the inner lid 11 and the check arms 7 may also be formed integrally. This reduces the number of parts in the console box 1, and therefore reduces the manufacturing cost of the box 1. Further, a complicated step for attaching the check arms 7 to the inner lid 11 is omitted.

A second embodiment of the present invention will be described with reference to FIGS. 6A, 6B and 7. To avoid a redundant description, like or same reference numerals are given to those components which are the same as the corresponding components of the first embodiment. The difference between the first embodiment and the second embodiment will be explained below.

Figure 6A:
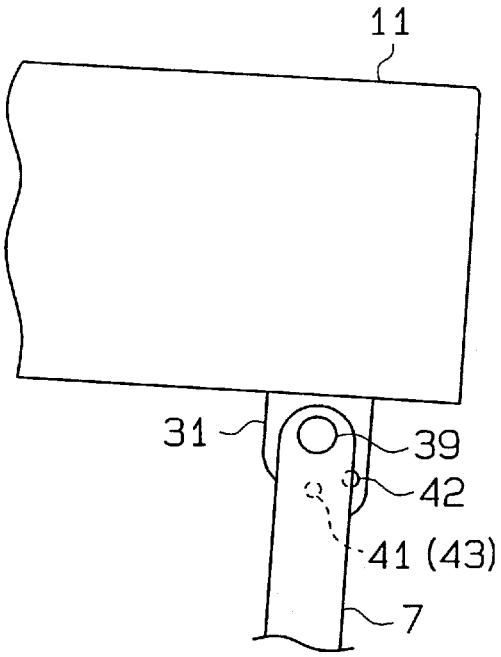
FIGS. 6A, 6B and 7 illustrate a second embodiment of the present invention.
Figure 6B:
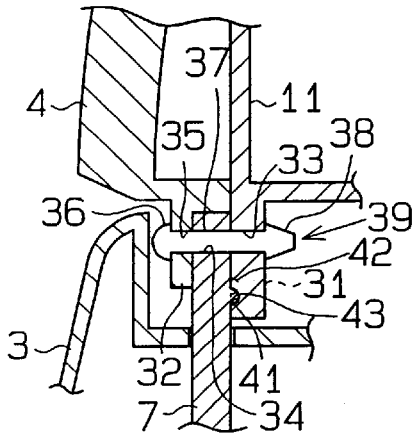

As shown in FIGS. 6A and 6B, assemblage of the outer lid 4, the inner lid 11 and check arms 7 is different from that of the first embodiment. A pair of integrally formed brackets 31 are located on both sides near the rear end of the inner lid 11. The outside surface of each bracket 31 contacts the first end of the check arm 7. The outer surface of the check arms 7 contacts the brackets 32 of the outer lid 4. The outer lid 4 has a pair of brackets 32 each of which is integrally formed with the side walls 4*c*, and are placed forward of the hinge 6. Holes of the same diameters 33, 34, 35 are formed in the bracket 31 of the inner lid 11, the first end of the check arms 7 and the outer lid's bracket 32, respectively. After matching the holes 33, 34, 35, a clip 39 having a head 36, a shaft 36 and an elastic large diameter portion 38 is inserted in the holes 33, 34, 35.

The inner lid's brackets 31 have a first and a second recess 41, 42 formed on its outside surface near the bottom end. The first and the second recesses 41, 42 are formed on the circumference of a circle having the clip 39 as the center. The first recess 41 is located directly below the hole 34. The second recess 42 is located a little behind the first recess 41. An elastic protrusion 43 having a predetermined stiffness is formed on the inside surface of each check arm 7. The position of the protrusion 43 corresponds to the position of the recesses 41, 42. In the closed position, the protrusion 43 is engaged with the first recess 41. This allows the check arms 7 and the inner lid 11 to rotate with respect to the outer lid 4 around the clip 39. When the inner lid's protrusions 43 engages with the recesses 41 or 42, the inner lid 11 is prevented from rotating with respect to the check arms 7.

Figure 7:
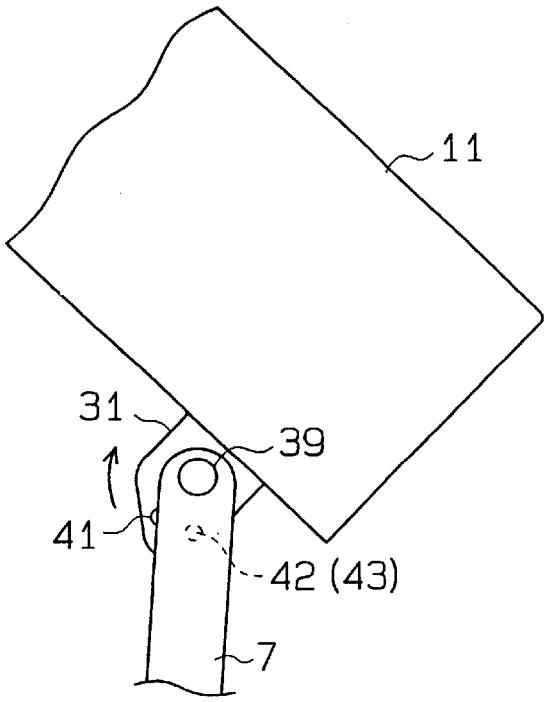
Figure 8:
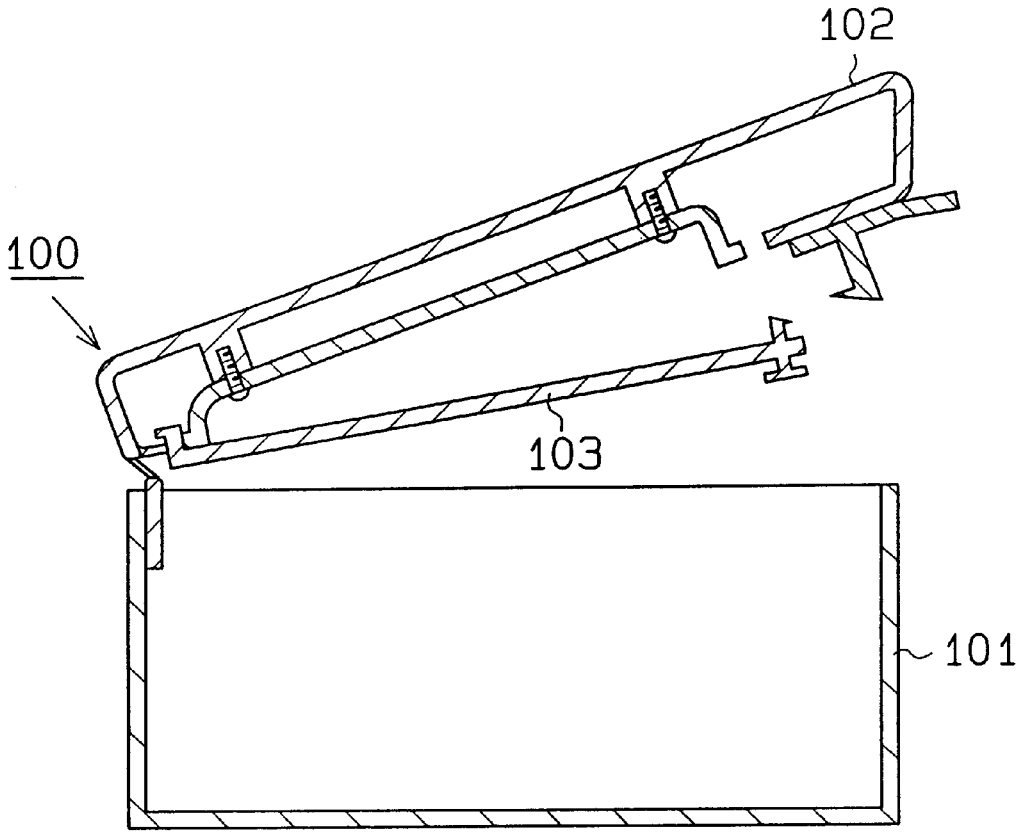
Fig.8 (Prior Art)
FIG. 8 is a cross-sectional view illustrating a prior art console box.

In the second embodiment, as shown in FIG. 7, when the outer lid 4 is opened, applying a force that is greater than a predetermined value to the inner lid 11 causes the inner lid 11 to rotate upwardly (the direction indicated by an arrow in the figure). This disengages the flexible protrusion 43 from the first recess 41. The protrusion 43 moves to the second recess 42 and becomes engaged with it. This allows the inner lid 11 to be accommodated in the space S2 inside the outer lid 4. Thus the inner lid 11 is held in the space S2 and the space S3 inside the inner lid 11 is closed.

The space S3 provides for concealed storage. Further, when accommodated in the space S2 of the outer lid 4 as described above, the inner lid 11 does not obstruct access to or use of the space S1.

In the second embodiment, the recesses 41, 42 are formed on the inner lid's brackets 31 and the protrusions 43 are formed on the check arms 7. However, the protrusions 43 may alternatively be formed on the brackets 31 and the recesses 41, 42 may be formed on the check arms 7.

In this embodiment, each of the inner lid's brackets 31 has two recesses 41,42. However, each bracket may have three or more recesses to allow the inner lid 11 to be held at several positions.

In the above embodiments, the hinge 6 is provided at the rear end of the box body 3. However, the hinge 6 may be provided at any part of the box body 3. The hinge 6 may be replaced by other connecting means such as a piano hinge or a butt hinge. The shapes of the box body 3, the outer lid 4, check arms 7 and the inner lid 11 are not limited to those presented in the above embodiments. The inner lid 11 does not necessarily have side walls, specifically, the inner lid 11 may be a flat plate as long as it closes the box body 3 and enables the usage of the space S3.

Although only several embodiments of the present invention have been described in detail herein, it should be apparent to those skilled in the art that the present invention may be embodied in many other specific forms without departing from the spirit or scope of the invention. Therefore, the present examples and embodiment are to be considered as illustrative and not restrictive and the invention is not to be limited to the details given herein, but may be modified within the scope of the appended claims.

What is claimed is:

1. A console box comprising:

a body having a first storage space;

an outer lid, pivotally connected to said body for opening and closing said body, wherein said outer lid has an interior space and wherein the outer lid pivots within a predetermined angle with respect to said body; and an inner lid defining an inner lid storage space, wherein the inner lid is located between said body and said outer lid, the inner lid being fully receivable within the outer lid's interior space when the outer lid is closed, and wherein the inner lid automatically pivots to an open position as the opening angle of the outer lid increases.

2. A console box according to claim 1, further comprising a check arm for connecting said outer lid with said inner lid.

3. A console box according to claim 2, wherein said body comprises a stopper for limiting a maximum opening angle of said outer lid, wherein said check arm has a first and a second end, wherein said first end is connected to both said outer and inner lids, and wherein said second end comprises a portion engageable with the stopper.

4. A console box according to claim 2, further comprising another check arm, wherein each check arm is located on opposite sides of the outer lid.

5. A console box according to claim 2, wherein the inner lid and the check arm are integrally formed.

6. A console box according to claim 1, wherein the outer lid comprises a hinge means for allowing the outer lid to pivot with respect to said body.

7. A console box comprising:

a body having a first storage space;

an outer lid, pivotally connected to said body for opening and closing said body, wherein the outer lid has an interior second space and wherein the outer lid pivots within a predetermined first angle with respect to said body;

an inner lid defining an internal third space, disposed between said body and the outer lid, the inner lid being fully receivable within the outer lid's interior second space when the outer lid is closed, the inner lid pivoting to an open position in accordance with an opening angle of the outer lid; and a check arm for connecting the outer lid with the inner lid, wherein the body comprises a stopper for limiting a maximum opening angle of the outer lid, and wherein the check arm has a first and a second end, the first end being connected to both the outer and inner lids, and the second end comprising a portion engageable with the stopper.

8. A console box according to claim 7, wherein the inner lid is fixed to the check arm, and wherein an angle formed by the inner lid and the check arm is smaller than an angle formed by the outer lid and the check arm when the second end of the check arm is engaged with the stopper.

9. A console box according to claim 7, wherein the inner lid and the check arm are connected together by a pin.

10. A console box according to claim 7, wherein the angle formed by the inner lid and the check arm is substantially equal to ninety degrees.

11. A console box according to claim 7, wherein the inner lid is pivotally supported by the check arm, and wherein the inner lid is accommodated in the second space by a pivoting motion of the inner lid with respect to the check arm when the second end of the check arm is engaged with the stopper.

12. A console box according to claim 11, wherein said first end of said check arm comprises a first side contacting said bracket, wherein said bracket has a second side contacting said first side, wherein said second side has a projection, and wherein said first side has a plurality of recesses selectively engageable with said projection.

13. A console box according to claim 11, wherein said first end of said check arm comprises a first side contacting with said bracket, wherein said bracket has a second side contacting with said first side, wherein said first side has a projection, and wherein said second side has a plurality of recesses selectively engageable with said projection.

14. A console box according to claim 7, wherein said first end of the check arm has a first hole, wherein the inner lid comprises a bracket having a second hole integrally formed therein, and wherein the first end of the check arm and the bracket are connected through said first and second holes.

15. A console box comprising:

a body having a first storage space;

an outer lid, pivotally connected to the body for opening and closing the body, wherein the outer lid has an interior space and wherein the outer lid pivots within a predetermined angle with respect to the body;

an inner lid defining an internal third space disposed between the body and the outer lid, the inner lid being fully receivable within the outer lid's interior second space when the outer lid is closed, and wherein the inner lid automatically pivots to an open position as an opening angle of the outer lid increases; and a pair of check arms connecting the outer lid with the inner lid, wherein the check arms are located on opposite sides of the outer lid, and wherein each check arm serves to limit the maximum opening angle of the outer lid.

16. A console box according to claim 15, wherein the inner lid is fixed to the check arms, and wherein an angle formed by the inner lid and the check arms is smaller than an angle formed by the outer lid and the check arms when the second end of the check arms is engaged with the stopper.

17. A console box according to claim 16, wherein the inner lid and the check arms are connected together by a pin.

18. A console box according to claim 16, wherein the angle formed by the inner lid and the check arms is substantially equal to ninety degrees.

19. A console box comprising:

a body having a first storage space;

an outer lid pivotally connected to the body for opening and closing the body, wherein the outer lid has a second interior space and wherein the outer lid pivots within a predetermined first angle with respect to the body; and an inner lid defining an internal third space, wherein the inner lid is located between the body and the outer lid, the inner lid being fully receivable within the outer lid's second interior space when the outer lid is closed, wherein the inner lid automatically pivots to an open position as an opening angle of the outer lid increases, wherein the inner lid starts to open when the outer lid is opened to a predetermined second angle with respect to the body, and wherein the difference between the opening angle of the outer lid and the inner lid allows manual access to the third space.

* * * * *

UNITED STATES PATENT AND TRADEMARK OFFICE

CERTIFICATE OF CORRECTION

PATENT NO. : 6,000,572
DATED : December 14, 1999
INVENTOR(S) : Junichiro KAKO ET AL.

It is certified that error appears in the above-identified patent and that said Letters Patent is hereby corrected as shown below:

Title page, item [73]

Please Add Second Assignee:

--ASSIGNEE: Toyoda Jidosha Kabushiki Kaisha, Aichi-ken, Japan--.

Signed and Sealed this

Sixth Day of June, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 6,000,572
DATED : December 14, 1999
INVENTOR(S) : Junichiro Kako, et. al.

It is certified that error appears in the above-indentified patent and that said Letters Patent is hereby corrected as shown below:

Title page, item [73], Assignee: second Assignee should read --Toyota Jidosha Kabushiki Kaisha--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*